US006190220B1

(12) United States Patent
Borrelli

(10) Patent No.: US 6,190,220 B1
(45) **Date of Patent: *Feb. 20, 2001**

(54) PROTECTIVE COVER AND METHOD FOR PROTECTING A BOAT PROPELLER SHAFT

(76) Inventor: Kenneth Borrelli, 1251 Hurffville Rd., Deptford, NJ (US) 08096

( * ) Notice: Under 35 U.S.C. 154(b), the term of this patent shall be extended for 0 days.

This patent is subject to a terminal disclaimer.

(21) Appl. No.: 09/457,185

(22) Filed: Dec. 8, 1999

(51) Int. Cl.[7] ..... B63H 20/32
(52) U.S. Cl. ..... 440/78; 440/49; 416/244 B
(58) Field of Search ..... 114/49, 900, 113, 114/78; 416/244 B, 245 A, 247 A, 62, 144 B; 33/244

(56) References Cited

U.S. PATENT DOCUMENTS

| | | | |
|---|---|---|---|
| D. 333,633 | 3/1993 | Issa . | |
| D. 402,667 | 12/1998 | Borrelli . | |
| 662,522 | 11/1900 | Butterworth . | |
| 2,143,693 | 1/1939 | Harris . | |
| 2,696,672 * | 12/1954 | Durfee | 33/244 |
| 2,822,183 | 2/1958 | Montgomery . | |
| 2,949,092 | 8/1960 | Fortune . | |
| 3,981,165 | 9/1976 | Wersinger . | |
| 4,257,247 | 3/1981 | Sims . | |
| 5,246,345 | 9/1993 | Adams, Jr. . | |
| 5,273,399 | 12/1993 | Ojeda . | |
| 5,470,262 | 11/1995 | Bustillo . | |

* cited by examiner

*Primary Examiner*—Ed Swinehart
(74) *Attorney, Agent, or Firm*—Norman E. Lehrer

(57) ABSTRACT

A protective cover and method for protecting a boat propeller shaft and gears within a lower gear housing of a boat includes a cone-shaped casing having an inner surface, an outer surface, a top, and an open bottom. The inner and outer surfaces have an edge in common in which two notches are formed and extend along the inner and outer surfaces. The notches are spaced 180° apart from each other and are aligned with and placed around the skeg and upper frame of the lower gear housing of the boat so that the propeller shaft and gears are covered. The casing is retained on the lower gear housing by an elastic band.

18 Claims, 1 Drawing Sheet

PROTECTIVE COVER AND METHOD FOR PROTECTING A BOAT PROPELLER SHAFT

BACKGROUND OF THE INVENTION

The present invention is directed toward a protective cover for a boat propeller shaft and a method for protecting the same, and more particularly, toward a cover and method for protecting the propeller shaft and gears within the lower gear housing while the boat is being stored.

When boats are sitting out of the water and the propellers are uncovered, the propellers are exposed to damage. Small nicks or blemishes in a propeller can substantially reduce efficiency. Propellers also present a risk of injury to people when the boat is out of water. That is, the blades of the propeller, if left uncovered may injure a person who comes in contact with the propeller inadvertently. Furthermore, propellers may be expensive or of a unique design so that special care should be given to them. Therefore, propellers are often removed before a boat is stored and are stored separately because they do require special care and should be protected separately. Furthermore, the risk of injury to people is reduced.

A problem which occurs when a boat propeller is removed, however, is that the propeller shaft and gears of the lower gear housing are exposed to water, dirt, and possible damage. Again, a person may be injured by the protruding propeller shaft. Another problem is that water from rain or condensation within the gears may, during the winter months, turn into ice, causing damage to the propeller shaft and gears. The dirt and debris may also cause damage to the gears. Therefore, the lower gear housing should also be removed, covered, and stored separately.

U.S. Pat. No. 5,246,345 discloses a propeller cover which completely encloses and locks the propeller without removing it from the boat so that the entire propeller is protected from damage and theft. The problem with this cover is that it is in two pieces which do not seal so that dirt and water may enter the cover and possibly damage the propeller. Another problem with the design of this cover is that it is large and bulky, thereby possibly creating a space problem when storing.

SUMMARY OF THE INVENTION

The present invention is designed to overcome the deficiencies of the prior discussed above. It is an object of the present invention to provide a protective cover for a boat propeller shaft which protects the propeller shaft and gears of the lower gear housing while the boat is being stored.

It is a further object of the invention to provide a protective cover with a retaining means which secures the cover to the gear housing.

In accordance with the illustrative embodiments demonstrating features and advantages of the present invention, there is provided a protective cover for a boat propeller shaft. The cover includes a casing in the shape of a truncated cone with an inner surface and an outer surface which surfaces have two notches formed therein and the notches are spaced 180° apart from each other. The cover is used with a retaining means which secures the casing onto the lower gear housing.

Other objects, features, and advantages of the invention will be readily apparent from the following detailed description of a preferred embodiment thereof taken in conjunction with the drawings.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODIMENT

Figure 3:
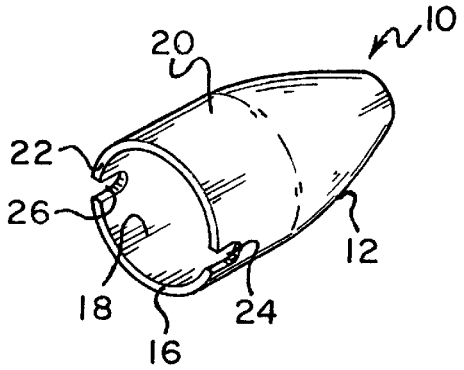
FIG. 3 is a rear perspective view of the cover of the present invention.

Referring now to the drawings in detail wherein like reference numerals have been used throughout the various figures to designate like elements, there is shown in FIG. 3 a protective cover constructed in accordance with the principles of the present invention and designated generally as 10.

Figure 4:
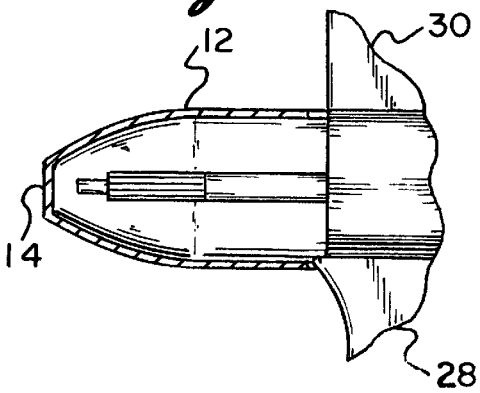
FIG. 4 is a cross section taken through line 4—4 of FIG. 1.

The protective cover 10 of the present invention includes a casing 12 with a flat top 14 and an open bottom 16. The casing 12 has a cylindrical portion 15 and a cone-shaped portion 17 with an inner surface 18 and an outer surface 20. The inner surface 18 and outer surface 20 share an edge 22 near the open bottom 16. On this edge 22 two notches 24 and 26 are formed which are located 180° apart from each other. The notches 24 and 26 extend upwardly along the inner surface 18 and outer surface 20 and are formed in such a manner so that the skeg 28 and upper frame 30 of the lower gear housing 32 of a boat may snugly fit within the same. (See FIG. 4.) The casing 12 may be made from plastic or any other durable material, such as steel or aluminum. The cover 10 also has an elastic band 34 or some other type of retaining means known in the art which secures the casing 12 on the gear housing 32.

Figure 1:
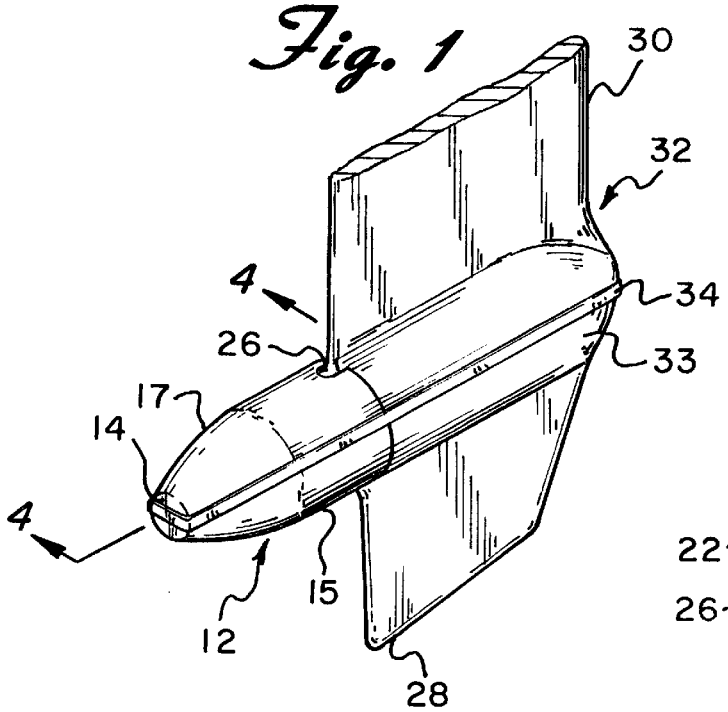
FIG. 1 is front perspective view of the cover of the present invention secured on a skeg and upper frame of the lower gear housing of a boat.
Figure 2:
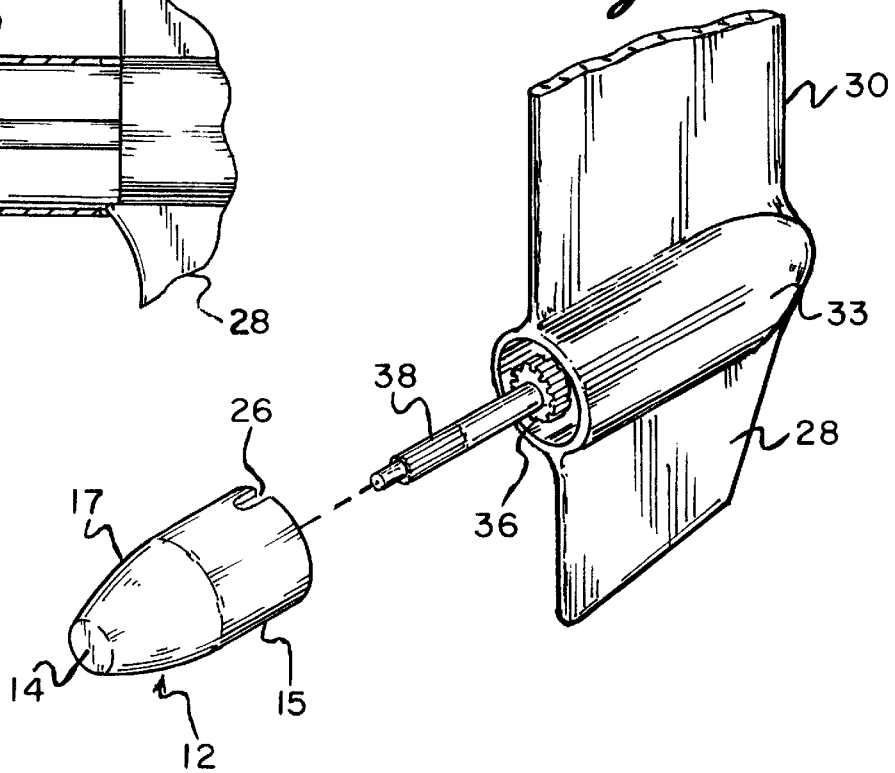
FIG. 2 is an exploded view of the present invention.

In order to use the protective cover 10 of the present invention the propeller of the boat is removed, exposing the gears 36 within the lower gear housing 32 and the propeller shaft 38 extending from the center of the housing 32. It should be noted that the lower gear housing 32 has a structure typically found on a boat, i.e., the housing 32 has a hollow, generally cylindrical body 33 with the skeg 28 and upper frame 30 extending from the length of the outer surface of the body 33. (See FIG. 2.) The cover 10 is placed over the gears 36 and propeller shaft 38 so that the notches 24 and 26 are aligned with and positioned around the skeg 28 and upper frame 30, respectively. The cover 10 has a diameter slightly larger than the lower gear housing 32 so that the cover 10 encloses the exposed gears 36 and propeller shaft 38, as seen in FIG. 1. The retaining means 34 is then placed around the casing 12 and lower gear housing 32 in order to keep the cover 10 in place on the skeg 28 and upper frame 30 of the housing 32. In this manner, gears 36 and propeller shaft 38 within the lower gear housing 32 are protected from water, dirt, and debris. It should be noted that various sizes of the cover may be produced to accommodate a wide variety of gear housings.

The present invention may be embodied in other specific forms without departing from the spirit or essential attributes thereof and accordingly, reference should be made to the appended claims rather than to the foregoing specification as indicating the scope of the invention.

I claim:

1. A method for protecting a propeller shaft and gears of a boat which are contained within a lower gear housing of a boat, the lower gear housing having a skeg and an upper frame, the method comprising the steps of:

providing a cone-shaped casing having an inner surface, an outer surface, a top, and an open bottom, said inner and outer surfaces having an edge in common at said bottom and two notches on said edge extending upwardly into said inner and outer surfaces;

removing a propeller from a boat so that the gears of the lower gear housing and propeller shaft are exposed;

placing said casing over the lower gear housing and propeller shaft of the boat; and aligning one of said notches with the skeg and the other of said notches with the upper frame of the lower gear housing while positioning said notches around said skeg and upper frame, respectively.

2. The method for protecting a boat propeller shaft and gears as claimed in claim 1 further including the step of providing means for retaining said casing on the lower gear housing and placing said retaining means around said casing and lower gear housing.

3. The method for protecting a boat propeller shaft and gears as claimed in claim 2 wherein said retaining means is an elastic band.

4. The method for protecting a boat propeller shaft and gears as claimed in claim 1 wherein said notches are spaced 180° apart from each other.

5. The method for protecting a boat propeller shaft and gears as claimed in claim 1 wherein said top is flat.

6. The method for protecting a boat propeller shaft and gears as claimed in claim 1 wherein said casing is plastic.

7. A lower gear housing of a boat and protective casing comprising:

a lower gear housing of a boat including a hollow, generally cylindrical body, an upper frame extending outwardly and upwardly along the length of the outer surface of said body and a skeg extending outwardly and downwardly along the length of the outer surface of said body, said body containing gears and a propeller shaft extending outwardly from the center of said body and a protective casing comprising an inner surface, an outer surface, a top, and an open bottom, said inner and outer surfaces having an edge in common at said bottom and two notches on said edge extending upwardly into said inner and outer surfaces, one of said notches aligned with and positioned on said upper frame and the other of said notches aligned and positioned on said skeg so that said propeller shaft and gears are covered.

8. The lower gear housing of a boat and protective casing as claimed in claim 7 wherein said top is flat.

9. The lower gear housing of a boat and protective casing as claimed in claim 7 wherein said notches are spaced 180° apart from each other.

10. The lower gear housing of a boat and protective casing as claimed in claim 7 including means for retaining said casing on said lower gear housing.

11. The lower gear housing of a boat and protective casing as claimed in claim 10 wherein said retaining means is an elastic band.

12. The lower gear housing of a boat and protective casing as claimed in claim 7 wherein said casing is plastic.

13. A protective cover for a boat propeller shaft and gears comprising:

a cone-shaped casing having an inner surface, an outer surface, a top, and an open bottom, said inner and outer surfaces having an edge in common at said bottom and two notches on said edge extending upwardly into said inner and outer surfaces.

14. The protective cover as claimed in claim 13 wherein said top is flat.

15. The protective cover as claimed in claim 13 wherein said notches are spaced 180° apart from each other.

16. The protective cover as claimed in claim 13 including means for retaining said casing on a lower gear housing of a boat.

17. The protective cover as claimed in claim 16 wherein said retaining means is an elastic band.

18. The protective cover as claimed in claim 13 wherein said casing is plastic.

* * * * *